United States Patent [19]

Nakamura

[11] 4,361,124

[45] Nov. 30, 1982

[54] SYSTEM FOR CONTROLLING AIR-FUEL RATIO

[75] Inventor: Hiroyuki Nakamura, Higashiyamato, Japan

[73] Assignees: Fuji Jukogyo Kabushiki Kaisha, Tokyo; Nissan Motor Co., Ltd., Yokohama, both of Japan

[21] Appl. No.: 174,380

[22] Filed: Aug. 1, 1980

[30] Foreign Application Priority Data

Aug. 2, 1979 [JP] Japan ..... 54-98921

[51] Int. Cl.[3] ..... F02M 7/00

[52] U.S. Cl. ..... 123/440; 123/489; 123/438

[58] Field of Search ..... 123/489, 493, 438, 440

[56] References Cited

U.S. PATENT DOCUMENTS

| | | | |
|---|---|---|---|
| 4,075,982 | 2/1978 | Asano et al. | 123/489 |
| 4,170,201 | 10/1979 | Camp et al. | 123/489 |
| 4,187,814 | 2/1980 | Phelan et al. | 123/438 |
| 4,241,710 | 12/1980 | Peterson, Jr. et al. | 123/489 |
| 4,289,103 | 9/1981 | Shinoda | 123/440 |

*Primary Examiner*—P. S. Lall

*Attorney, Agent, or Firm*—Martin A. Farber

[57] ABSTRACT

An electronic control system for controlling the air-fuel ratio for an internal combustion engine comprising an on-off type electromagnetic valve for correcting the air-fuel ratio of the air-fuel mixture supplied by an air-fuel mixture supply device, a comparing circuit for comparing the output signal of a detector with a reference value, an integration circuit connected to the comparing circuit, a pulse generator, and a comparator for producing pulses for driving the on-off type electromagnetic valve from output signals of the integration circuit and of the pulse generator for controlling the air-fuel ratio to a value substantially equal to the stoichiometric air-fuel ratio. A first converter converts the operation of the throttle valve to an electric quantity output, a second converter converts the prevailing ambient atmospheric pressure to another electric quantity output. Further, there is provided switches actuated by the output signals of the first converter for rendering the integration circuit non-responsive to the output of the detector and responsive to the output of the second converter.

14 Claims, 1 Drawing Figure

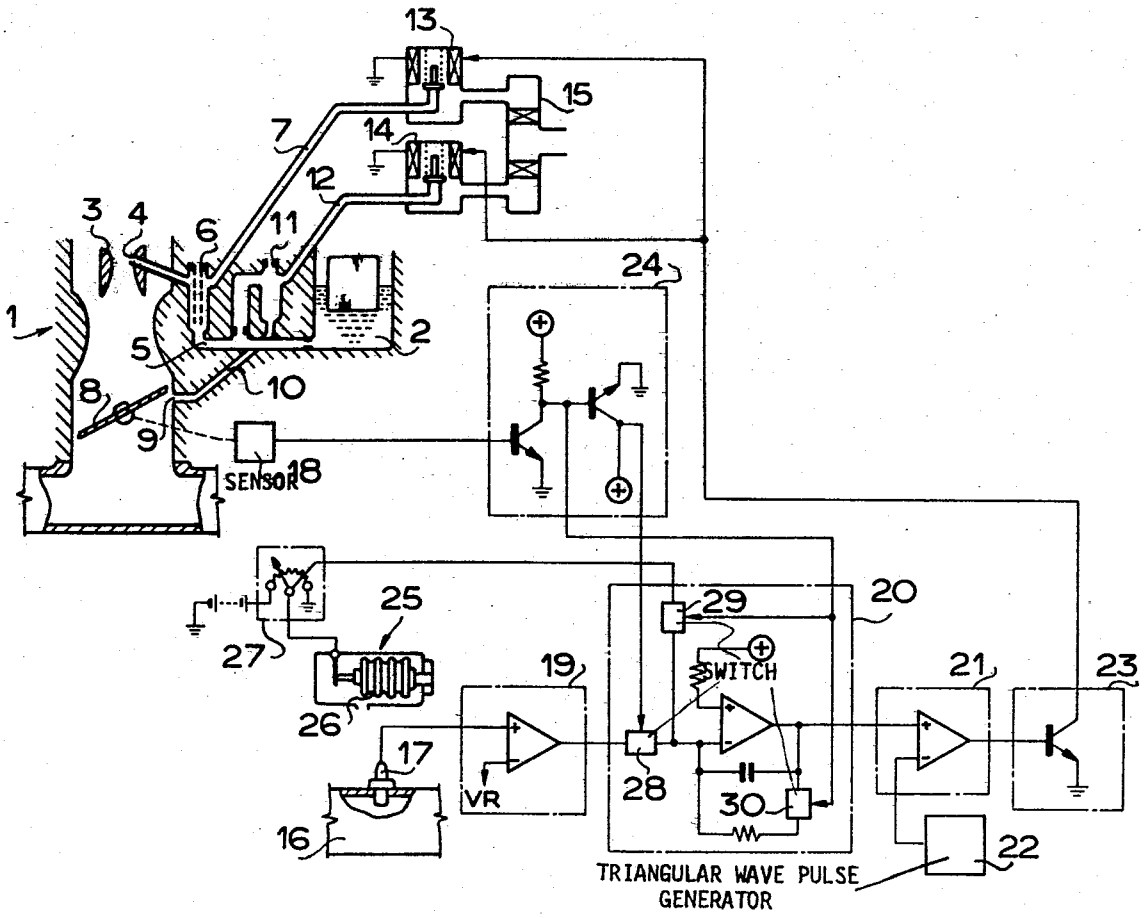
TRIANGULAR WAVE PULSE GENERATOR
SWITCH
SENSOR
VR

SYSTEM FOR CONTROLLING AIR-FUEL RATIO

BACKGROUND OF THE INVENTION

The present invention relates to a system for controlling the air-fuel ratio for an internal combustion engine having an emission control system with a three-way catalyst and more particularly to a system for controlling the air-fuel ratio during the idling and heavy load operations at a high altitude for improving the fuel consumption and emission control.

Such a system as in U.S. Pat. No. 4,132,199 comprises a feedback control system, in which an oxygen sensor is provided to sense the oxygen content of the exhaust gases to generate an electrical signal as an indication of the air-fuel ratio of the air-fuel mixture supplied to the engine. The control system operates to actuate an air-fuel mixture supply means with a duty ratio correcting means to control the air-fuel ratio of the mixture of the stoichiometric air-fuel ratio in response to the signal from the oxygen sensor. In such a system, the feedback control with the oxygen sensor is not operated during the idling and heavy load operations of the engine and the system acts in a manner so as to operate the air-fuel mixture supply means with a predetermined duty ratio, in order to stabilize the idling operation respectively and to perform a high power operation. However, the duty ratio of the supply means is adjusted so as to supply a mixture having an air-fuel ratio sufficient to improve the operation at a low altitude. Therefore, when the air-fuel mixture supply means is fixed to the predetermined duty ratio at a high altitude during idling and heavy load operations, the air-fuel ratio of the mixture supplied by the supply means decreases because of a decrease in the oxygen concentration in the air. Thus, a rich air-fuel mixture is supplied to the engine, which will result in disadvantageous fuel consumption and emission control effect.

SUMMARY OF THE INVENTION

The object of the present invention is to provide a system which can correct the air-fuel ratio during idling and heavy load operation at a high altitude so as to prevent the enrichment of the air-fuel mixture.

According to the present invention, there is provided in a system for controlling the air-fuel ratio for an internal combustion engine having an induction passage, an air-fuel mixture supply means, a throttle valve, an exhaust passage, detecting means for detecting the concentration of a constituent of the exhaust gases passing through the exhaust passage, an electronic control circuit, and electromagnetic valve means actuated by the output signal from the electronic control circuit for correcting the air-fuel ratio of the air-fuel mixture supplied by the air-fuel mixture supply means dependent on the detecting means, the improvement comprising first converting means for converting the operation of the throttle valve to an electric quantity output signal, second converting means for converting the presently existing ambient atmospheric pressure to another electric quantity output signal, actuating means dependent on the output signal of the first converting means for rendering the electronic control circuit non-responsive to the output signal from the detecting means, and dependent on the output signal of the first converting means for feeding the output signal of the second converting means to the electronic control circuit.

Other objects and features of the present invention will become apparent from the following description with reference to the accompanying drawing.

BRIEF DESCRIPTION OF THE DRAWING

The only FIGURE is a schematic view of a system for controlling air-fuel ratio according to the present invention.

DETAILED DESCRIPTION OF THE PREFERRED EMBODIMENT

Referring to FIG. 1, a carburetor 1 communicates with an internal combustion engine (not shown) and comprises a float chamber 2, a venturi 3, a nozzle 4 which communicates with the float chamber 2 through a main fuel passage 5, and a slow port 9 communicates with the float chamber 2 through a slow fuel passage 10. Air correcting passages 7 and 12 are provided in parallel to a main air bleed 6 and a slow air bleed 11, respectively. On-off type electromagnetic valves 13 and 14 are provided for the air correcting passages 7 and 12. The inlet port of each on-off electromagnetic valve communicates with the atmosphere through an air filter 15. An oxygen sensor 17 is disposed in an exhaust pipe 16 which communicates with the exhaust port of the engine combustion cylinder (not shown) for detecting the oxygen content of the exhaust gases. A three-way catalytic converter (not shown) is provided in the exhaust pipe 16 downstream of the oxygen sensor 17. A throttle sensor 18 comprising a potentiometer is provided for detecting and converting the degree of opening of the throttle valve 8 into a corresponding representative voltage.

In accordance with the present invention, an altitude detecting means 25 is provided. The altitude detecting means comprises a bellows 26 and a potentiometer 27 operatively connected to a moving part of the bellows. The voltage converted by the potentiometer is in proportion to the atmospheric pressure representative of the altitude of the position of the engine.

The throttle sensor 18 is connected to a switch actuating circuit 24 which in turn is connected to an electronic control circuit of a feedback control system. The electronic control circuit comprises a comparing circuit 19 comprising a comparator, an integration circuit 20, a comparator 21, and a driving circuit 23. The integration circuit has an error signal input switch 28, an altitude input switch 29, and an integration disabling switch 30. The output of the potentiometer 27 is connected to the switch 29 of the integration circuit 20. The first output of the switch actuating circuit 24 is connected to control gates of switches 29 and 30 and the second output of the circuit 24 is connected to the gate of the switch 28.

When the output voltage of the throttle sensor 18 is high during partial load of the engine, the first output voltage of the switch actuating circuit 24 is low and the second output voltage is high thereby causing the switches 29 and 30 to open via their gates and the switch 28 to close via its gate. This is a normal feedback control condition.

In this condition output signal of the oxygen sensor 17 is fed to the comparing circuit 19 comprising a comparator. The judgement circuit 19 operates to compare the input signal from the oxygen sensor 17 with a reference voltage $V_R$ corresponding to the stoichiometric air-fuel ratio and to detect whether the input signal is rich or lean compared with the reference stoichiometric ratio so as to produce a comparing signal. The judgement signal is sent to the integration circuit 20 through the switch 28 where the signal is converted to an integration signal which varies in an opposite direction to the direction represented by the input comparing signal. The integration signal is compared in the comparator 21 with triangular wave pulses applied from a triangular wave pulse generator 22 so that square wave pulses are produced. The square wave pulses are fed to the on-off electromagnetic valves 13 and 14 via the driving circuit 23. When the oxygen sensor 17 senses rich exhaust gases, a higher voltage is produced from the oxygen sensor. Accordingly, the output of the integration circuit 20 increases and thereby the comparator 21 produces output pulses having a greater pulse duty ratio, whereby the amount of air passing through the on-off electromagnetic valves 13 and 14 increases. Thus, the amount of air in the mixture which is fed from the carburetor 1 increases to thereby increase the air-fuel ratio. When a lean air-fuel ratio is detected, an output having a smaller pulse duty ratio is produced whereby the air-fuel ratio is decreased to enrich the mixture. When the throttle sensor 18 generates a low level signal in the idling operation or the fully opened condition for heavy load operation, the first and second outputs of the switch actuating circuit 24 are inverted, so that the switch 28 is opened and switches 29 and 30 are closed via their respective gates. Consequently, the output voltage of the potentiometer 27 is applied to the integration circuit 20 through the closed switch 29. However, the integration circuit 20 does not act as an integrator to integrate the input, but because the integrator disabling switch is closed it produces an output dependent on the input voltage applied from the potentiometer 27.

The potentiometer 27 is so arranged as to produce a lower output voltage at the normal altitude and a higher output voltage with an increase in the altitude. Accordingly, at the normal altitude and in the idling operation or the heavy load operation, the on-off electromagnetic valves 13 and 14 are operated at a small duty ratio to provide a rich air-fuel mixture.

When the potentiometer 27 generates output signals at a high altitude and produces a high output voltage, the on-off electromagnetic valves 13 and 14 operate at a greater pulse duty ratio, so that a mixture having an air-fuel mixture substantially equal to an optimum mixture at a normal altitude is supplied.

In accordance with the present invention, the air-fuel ratio of the mixture during the idling and heavy load operations at a high altitude is corrected to a proper value so as to prevent excessive fuel enrichment of the mixture. Thus, the fuel consumption and emission control effect is improved. An electronic fuel injection device may be substituted for the carburetor 1 and a vacuum sensor for detecting the vacuum in the induction passage of the engine may be employed instead of the throttle sensor 18.

What is claimed is:

1. In a system for controlling the air-fuel ratio for an internal combustion engine having an induction passage, air-fuel mixture supply means, a throttle valve in the induction passage, an exhaust passage communicating with the engine, detecting means for detecting the concentration of a constituent of exhaust gases passing through said exhaust passage, an electronic control circuit operatively connected to an output of said detecting means and electromagnetic valve means actuated by an output signal from said electronic control circuit for correcting the air-fuel ratio of the air-fuel mixture supplied by said air-fuel mixture supply means dependent on said detecting means, the improvement comprising first converting means for converting the a condition in the induction passage to an electric quantity first output signal, second converting means for converting a presently existing ambient atmospheric pressure at an altitude of the engine to a corresponding electric quantity second output signal, first means dependent on the first output signal of said first converting means for rendering said electronic control circuit non-responsive to an output from said detecting means, second means dependent on the first output signal of said first converting means for feeding said second output signal of said second converting means to said electronic control circuit for controlling the air-fuel ratio to a proper value in dependency on the altitude of the engine.

2. The system according to claim 1 wherein said electromagnetic valve means is an on-off type electromagnetic valve means.

3. The system as set forth in claim 1, wherein said first converting means is a means for converting the operation of the throttle valve into said first output signal.

4. The system as set forth in claim 1, further wherein said first means includes a first switch means for connecting said output of said detecting means to said electronic control circuit, said first switch means has a first gate means for being operatively controlled by the first output signal of said first converting means, said second means for feeding said second output signal of said second converting means to said electronic control circuit includes a second switch means operatively connecting an output of second converting means to said electronic control circuit, said second switch means having a second gate means for being operatively controlled by the first output signal of said first converting means.

5. The system as set forth in claim 2 or 4, wherein said first means is for rendering said electronic control circuit non-responsive to the output signal from said detecting means when said first converting means detects an idling and heavy load operation condition, respectively, in the induction passage, said second means is for feeding said second output signal of said second converting means to said electronic control circuit when said first converting means detects the idling and heavy load operation condition, respectively, in the induction passage.

6. The system as set forth in claim 5, wherein said first means is for rendering said electronic control circuit responsive to the output signal from said detecting means when said first converting means detects a partial load operation condition in the induction passage, said second means is for disconnecting said second output signal of said second converting means from said electronic control circuit when said first converting means detects the partial load operation condition in the induction passage.

7. The system as set forth in claim 5, wherein said second converting means includes a bellows having a moving part operatively communicating with the ambient atmospheric pressure and a potentiometer operatively connected to said moving part and connected to a predetermined voltage such that when the ambient atmospheric pressure is low at a high altitude, said second output signal from said second converting means is higher than when said ambient atmospheric pressure is normal, said electronic control circuit includes a means for comparing said second output signal of said second converting means with a predetermined value and providing an output therefrom when said first converting means detects the idling and heavy load operation condition, respectively, in the induction passage.

8. The system as set forth in claim 1, wherein said second output signal is proportional to the atmospheric pressure and is higher with an increase in said altitude, said electronic control circuit includes means for providing a greater pulse duty ratio when said second output signal is higher than a lower value thereof when said second output signal is fed to said electronic control circuit as well as, respectively, when said output of said detecting means is higher than a lower value thereof when said electronic control circuit is responsive to said output of said detecting means.

9. The system as set forth in claim 1, 4 or 8 wherein said electronic control circuit includes an integration circuit operative when said electronic control circuit is responsive to said output of said detecting means, a third switch means for converting said integration circuit into a circuit having an output dependent on said second output signal when said first means renders said electronic control circuit non-responsive to the output of said detecting means and said second means feeds said second output signal to said electronic control circuit.

10. The system as set forth in claim 9, wherein said integration circuit includes an operational amplifier having a positive input connected to a voltage source, a capacitor connected across a negative input terminal of said operational amplifier and an output thereof and a resistor and said third switch means connected in series and together in parallel across said capacitor, said third switch means for being connected when said first converting means detects an idling and heavy load operation condition, respectively, in the induction passage and for being disconnected when said first converting means detects partial load.

11. The system as set forth in claim 4, further comprising a switch actuating circuit connected to said first converting means and having a first output controllably connected to said second switch means and a second output controllably connected to said first switch means, said second output and said first output have opposite voltage signals.

12. The system as set forth in claim 11, further comprising said electronic control circuit includes an integration circuit operative when said electronic control circuit is responsive to said output of said detecting means, a third switch means for converting said integration circuit into a circuit having an output dependent on said second output signal when said first means renders said electronic control circuit non-responsive to the output of said detecting means and said second means feeds said second output signal to said electronic control circuit, said first output is controllably connected to said third switch means.

13. The system as set forth in claim 11, wherein said switch actuating circuit includes a first transistor, said first converting means has an output connected to a base of said first transistor, said switch actuating circuit includes a second transistor and a base thereof connected to the collector of said first transistor, the latter constituting said first output of said switch actuating circuit, and a collector of said second transistor constitutes said second output of said switch actuating circuit.

14. The system as set forth in claim 13, wherein when said first converting means detects an idling and heavy load operation condition, respectively, in the induction passage, said first output has a high signal and said second output has a low signal, and when said first converting means detects a partial load operation condition, in the induction passage said first output has a low signal and said second output has a high signal.

* * * * *

UNITED STATES PATENT AND TRADEMARK OFFICE

CERTIFICATE OF CORRECTION

PATENT NO. : 4,361,124

DATED : November 30, 1982

INVENTOR(S) : Hiroyuki Nakamura

It is certified that error appears in the above-identified patent and that said Letters Patent are hereby corrected as shown below:

Column 4, Line 43, (claim 5) "2" should read --1--

Signed and Sealed this

First Day of March 1983

[SEAL]

Attest:

GERALD J. MOSSINGHOFF

Attesting Officer

Commissioner of Patents and Trademarks